US007357702B2

(12) United States Patent
Ficai

(10) Patent No.: US 7,357,702 B2
(45) Date of Patent: Apr. 15, 2008

(54) GRINDING WHEEL

(76) Inventor: Giovannii Ficai, Strada Della Costa, 23, Izzano Taro (PR) (IT) 43046

( * ) Notice: Subject to any disclaimer, the term of this patent is extended or adjusted under 35 U.S.C. 154(b) by 0 days.

(21) Appl. No.: 11/607,898

(22) Filed: Dec. 4, 2006

(65) Prior Publication Data

US 2007/0128996 A1 Jun. 7, 2007

(30) Foreign Application Priority Data

Dec. 7, 2005 (IT) ..... MO2005A0327

(51) Int. Cl.
*B24B 45/00* (2006.01)

(52) U.S. Cl. ..... 451/508; 451/541

(58) Field of Classification Search ..... 451/508, 451/509, 359, 490, 541, 548
See application file for complete search history.

(56) References Cited

U.S. PATENT DOCUMENTS

| | | | | |
|---|---|---|---|---|
| 2,278,301 | A * | 3/1942 | Bauer | 451/548 |
| 3,041,797 | A * | 7/1962 | Moffly | 451/510 |
| 3,808,753 | A * | 5/1974 | Maran | 451/490 |
| 3,912,411 | A * | 10/1975 | Moffat | 403/259 |
| 4,653,236 | A * | 3/1987 | Grimes et al. | 451/533 |
| 4,694,615 | A * | 9/1987 | MacKay, Jr. | 451/342 |
| 5,287,659 | A | 2/1994 | Timmons et al. | |
| 6,379,234 | B1 | 4/2002 | MacKay | |

FOREIGN PATENT DOCUMENTS

| | | |
|---|---|---|
| DE | 8 904 188 | 7/1989 |
| DE | 10 2004 022 968 | 10/2005 |
| DE | 20 2005 013 880 | 2/2007 |
| EP | 0 615 815 | 9/1994 |
| FR | 2 860 449 | 4/2005 |
| WO | WO 00/76727 | 12/2000 |
| WO | WO 2007/026007 | 3/2007 |

* cited by examiner

*Primary Examiner*—Robert Rose
(74) *Attorney, Agent, or Firm*—Young & Thompson

(57) ABSTRACT

The present invention refers to an improved grinding wheel, comprising an abrasive and/or cutting disk-shaped member that can be associated substantially coaxially with the free end of the rotating shaft of a grinding machine and equipped with at least one substantially central through-hole, with a first face that can be placed, in its assembling configuration, substantially oriented towards the machine and in contact with a machine bearing flange, and with a second face opposite to the first face, that comprises at least one threaded ring nut for attaching to the free end of the rotating shaft that is associated integral and unmovable with the substantially central portion of the second face.

2 Claims, 3 Drawing Sheets

GRINDING WHEEL

The present invention deals with an improved grinding wheel for lapping machines or the like.

Grinding wheels commonly used for cutting, grinding or polishing operations consist in a disk made of abrasive material and resin binder that, assembled on suitable grinding machines, commonly called angular lapping machines, is rotated around its own axis and then it is passed on the work-piece, or vice versa.

Grinding machines for assembling the work-piece are equipped with a rotating shaft, with centring, abutment and threaded at its free end.

Abrasive disk grinding wheels, both of the plane or of the recessed centre type, are equipped with a central hole that can be coupled with said rotating shaft, to which they are made integral through particular fastening means. Such fastening means are usually composed of a pair of flanges, the first one of which is inserted on the shaft, is equipped with facets that, by being coupled with the adequate shaft centring, transmit the grinding machine torque, and insists on the upper grinding wheel face, the second one of which is screwed along the rightward—self-tightening—direction and tightens the grinding wheel in contrast with the first flange.

These traditional grinding wheels are not free from inconveniences, among which there is the fact that their assembling and disassembling on/from the rotating shaft are rather cumbersome.

Flanges are subjected to wear, particularly dealing with holes aimed to the locking key that often does not adhere due to burrs generated by its use.

Moreover, the fact that operators responsible for assembling and/or replacing traditional grinding wheels have to handle small sized flanges, that are subjected to be lost, must not be neglected.

More or less automated variations of the second flange are known, that consist in costly quick unlocking mechanisms. Tightening is normally performed without using keys, due to the self-tightening action that is obtained by locking the lapping machine rotating shaft with the suitable device with which they are almost always equipped and performing a manual rightward rotation to the flange(s) or the grinding wheel.

Disassembling of these quick unlocking mechanisms is often cumbersome due to the wear due to severe working conditions associated with a continuous use with abrasive powders, that generate a short life.

As alternative to the previously described screwing and fastening means, grinding wheels are known assembled on a threaded ring nut that allows fastening them to the rotating shaft.

These metal ring nuts—usually made of aluminium and/or its alloys—are glued or otherwise made integral with the grinding wheels themselves and are applied onto the upper face of the abrasive disk that, in its assembling configuration, is facing the rotating shaft of the lapping machine.

These ring nuts are a normal equipment in the majority of grinding wheels used in the U.S., since particular safety standards impose their adoption.

Also such grinding wheels, however, have some inconveniences, the most important of which is that, in case of accidental detachment of the abrasive disk from the ring nut—due, for example, to anomalous stresses or faulty gluing—this latter one is free to be propelled at high speed with relevant risks for the safety of operators and/or other nearby people.

Object of the present invention is removing the above mentioned prior art inconveniences, by providing an improved grinding wheel that can be practically and easily used, can be assembled and disassembled on/from grinding machines easily and with quick times, and can be used without risks of accidental detachments from the machine, under maximum use efficiency and operators safety conditions.

Within such technical field, another object of the present invention is performing the previous tasks with a simple, economic structure that can be easily practiced, safely used and efficiently operated.

This and other objects are all obtained by the present improved grinding wheel, comprising an abrasive and/or cutting disk-shaped member that can be associated substantially coaxially with the free end of the rotating shaft of a grinding machine and equipped with at least one substantially central through-hole, with a first face that can be placed, in its assembling configuration, substantially oriented towards said machine and in contact with a machine bearing flange, and with a second face opposite to said first face, characterised in that it comprises at least one threaded ring nut for attaching to said free end of the rotating shaft that is associated integral and unmovable with the substantially central portion of said second face.

Further characteristics and advantages of the present invention will be better pointed out by the detailed description of some preferred, but not exclusive, embodiments, of an improved grinding wheel according to the invention, shown, merely as a non-limiting example, in the enclosed tables of drawing, in which.

Figure 1:
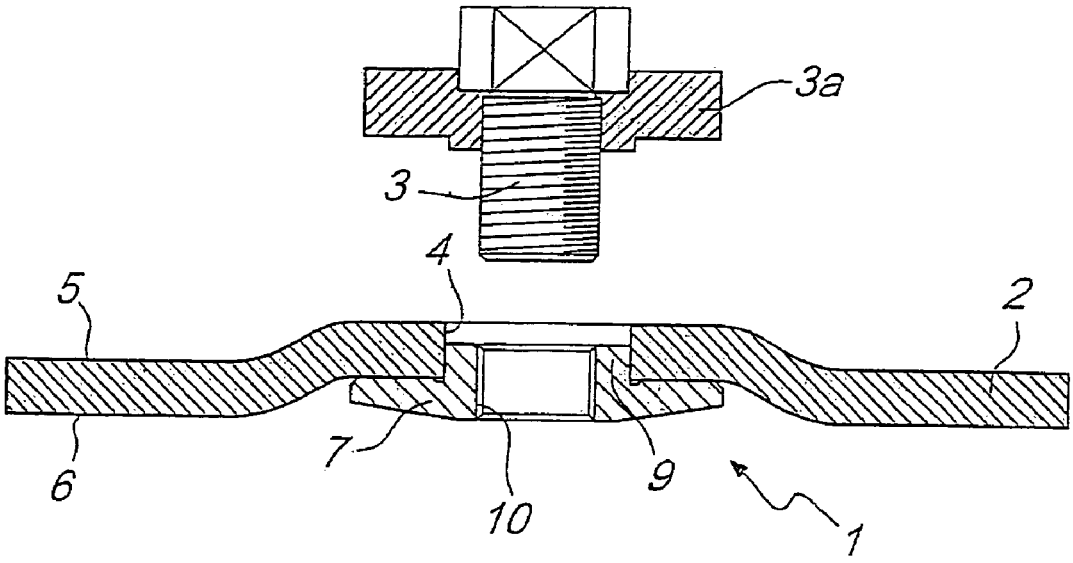
FIG. 1 is a cross sectional view of a first embodiment of the grinding wheel according to the invention before its assembling on the rotating shaft of a machine for rotating the grinding wheel.

FIGS. 5*a* to 5*d* are front views of some embodiments of the threaded ring nut of the grinding wheel according to the invention.

With particular reference to such figures, 1 globally designates an improved grinding wheel according to the invention.

The grinding wheel 1 comprises an abrasive and/or cutting disk-shaped member 2, that can be assembled substantially coaxially with the free end of the rotating shaft 3 of a machine for rotating the grinding wheel 1.

The disk-shaped member 2 is provided with a substantially central through-hole 4, with a first face 5 that, in its assembling configuration, can be placed substantially oriented towards the machine and in contact with a bearing flange 3*a* with which the machine itself is equipped, and with a second face 6, that is opposite to the first face.

The grinding wheel 1 further comprises a threaded ring nut 7 for connecting with the free end of the rotating shaft 3, that is associated integral and unmovable with the central portion of the second face 6.

The threaded ring nut 7 is applied to the disk-shaped member 2 by interposing a layer of adhesive material, or through mechanical interference between a cylindrical section 9 of the threaded ring nut 7 and the through-hole 4; this prevents the threaded ring nut 7 from detaching from the disk-shaped member 2 during handlings while, during use, the mechanical motion and torque transmission from rotating shaft 3 to grinding wheel 1 is ensured by tightening the grinding wheel against the bearing flange 3*a*.

The surface of the threaded ring nut 7 associated with the second face 6 is substantially plane and smooth; alternatively, it has a surface knurling with concentric or radial lines, or with patterns obtained by the assembly of the two, that is obtained by relief or engraved to increase the attaching surface of the layer of adhesive material, if provided.

The surface of the threaded ring nut 7 opposite to the second face 6, instead, can provide for a plurality of grooves 8*a* and/or ribs 8*b* with different shapes and sizes, of the type like those shown in FIGS. 5*a* to 5*d*, that allow facilitating assembling and disassembling the grinding wheel 1 on/from the rotating shaft 3 and/or reducing the global weight of the threaded ring nut 7 without impairing its structural strength; on such surface, moreover, characters, writing, logos, signs, symbols and/or drawings can be included through stamping, screen-printing, drum-printing, with bas-relief or high relief.

The threaded ring nut 7, in detail, is equipped with a central threaded hole 10 coaxial with the disk-shaped member 2 that, in its assembling configuration, can be coupled with corresponding threaded means obtained on the free end of the rotating shaft 3.

Figure 2:
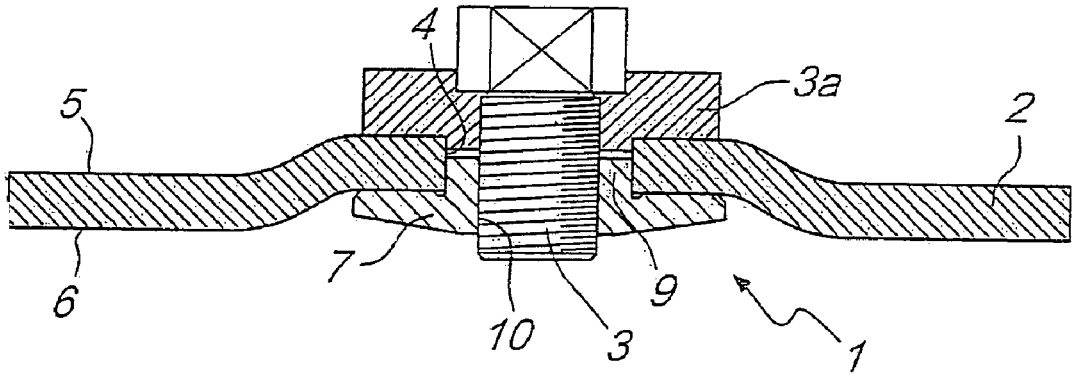
FIG. 2 is a cross sectional view of the grinding wheel of FIG. 1 assembled on the rotating shaft of a machine for rotating the grinding wheel.

The disk-shaped member 2 can have different shapes and sizes; in the embodiment of the invention shown in FIGS. 1 and 2, for example, the grinding wheel 1 is of a type with lowered centre, namely it has a concavity next to the central portion of the second face 6, and the threaded ring nut 7 is arranged substantially encased inside such central concave portion.

In this embodiment, the thickness of the disk-shaped member 2 is such as to allow housing inside the through-hole 4 both the cylindrical section 9 of the threaded ring nut 7 and the centring edge projecting from the bearing flange 3*a*.

Figure 3:
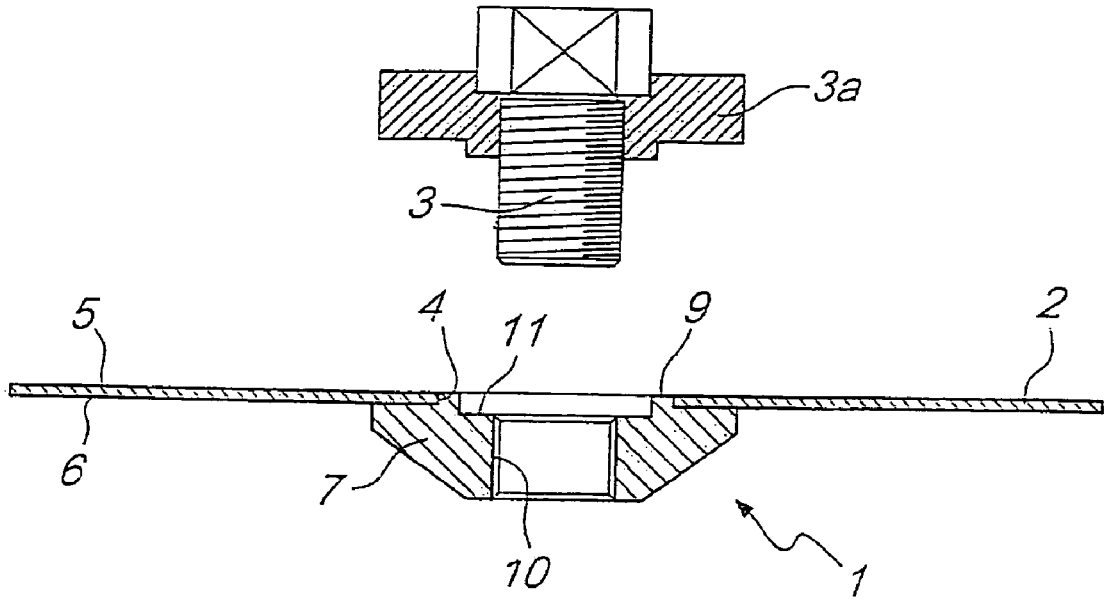
FIG. 3 is a cross sectional view of a second embodiment of the grinding wheel according to the invention before its assembling on the rotating shaft of a machine for rotating the grinding wheel.
Figure 4:
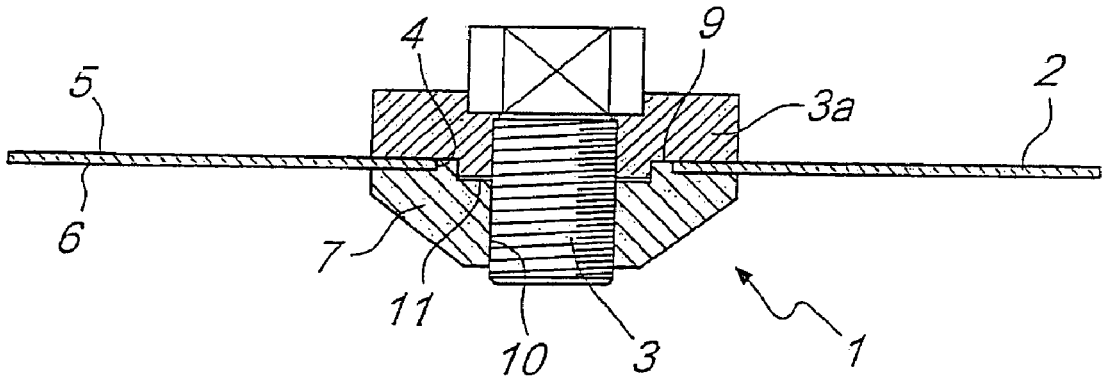
FIG. 4 is a cross sectional view of the grinding wheel of FIG. 3 assembled on the rotating shaft of a machine for rotating the grinding wheel.
Figure 5A:
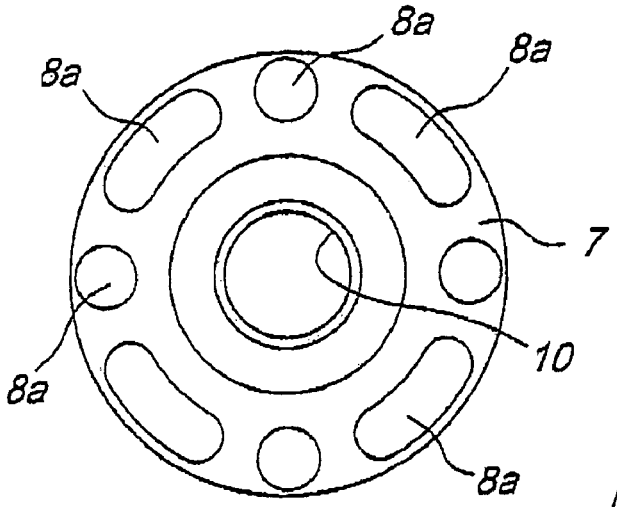
Figure 5B:
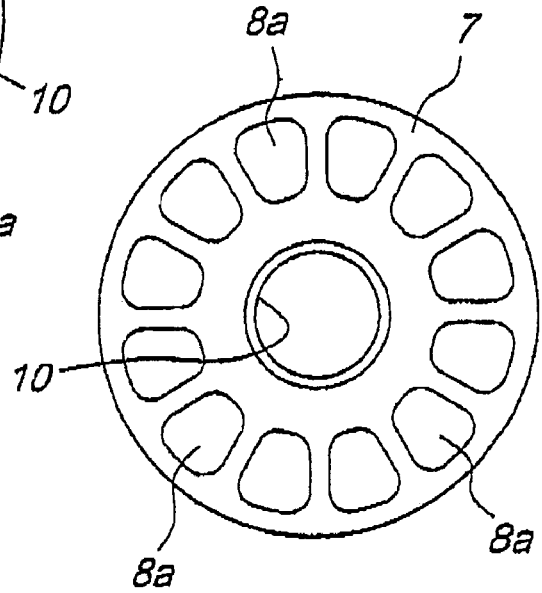
Figure 5C:
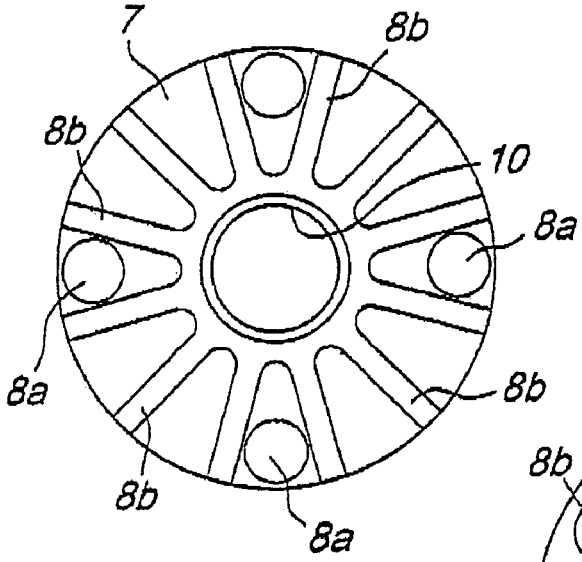
Figure 5D:
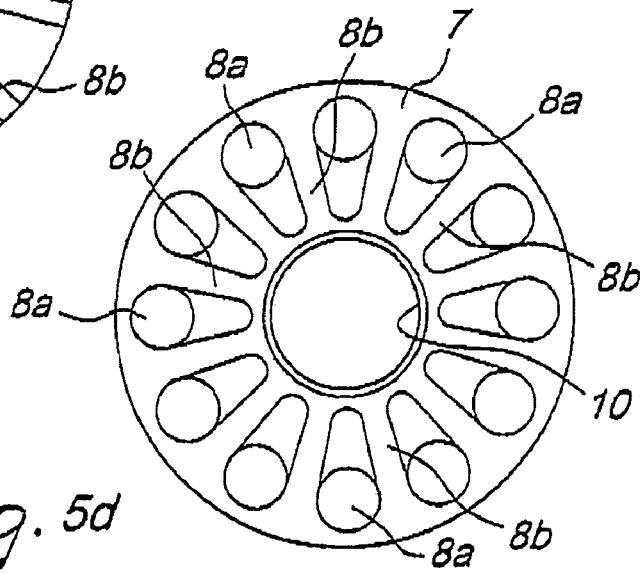

In the embodiment shown in FIGS. 3 and 4, instead, the disk-shaped member 2 is substantially plane and the threaded ring nut 7 is arranged projecting with respect to the second face 6.

In this second embodiment, the thickness of the grinding wheel 1 is particularly limited and does not allow accommodating, inside the through-hole 4, both the cylindrical section 9 and the centring edge of the bearing flange 3*a*; in such case, the threaded ring nut 7 is shaped in order to have a recess 11 for housing the centring edge of the bearing flange 3*a*.

In practice, it has been proven how the described invention reaches the proposed objects.

For such purpose, it must be underlined that the particular arrangement of using a threaded connection ring nut assembled from the external part of the grinding wheel, namely on the opposite side with respect to the machine and not towards the machine as occurs in case of glued metallic ring nuts used in the U.S., allows simplifying the operations of applying and removing the grinding wheel on/from the rotating shaft, of stably keeping the grinding wheel during its use and of removing the danger of detaching the grinding wheel from the machine apart from the piercing of the grinding wheel itself or the ring nut threading.

The thereby arranged invention may be subjected to numerous modifications and variations, all falling within the scope of the inventive concept.

Moreover, all details can be replaced with other technically equivalent members.

In practice, used materials, in addition to relevant shapes and sizes, can be any one according to the needs, without departing from the scope of the following claims.

The invention claimed is:

1. Improved grinding wheel, comprising:

an abrasive or cutting disk-shaped member that can be associated substantially coaxially with a free end of a rotating shaft of a grinding machine and that has at least one substantially central through-hole, with a first face that can be placed oriented towards said machine and in contact with a machine bearing flange, and with a second face opposite to said first face, at least one threaded ring nut for attaching to said free end of the rotating shaft that is associated integrally and immovably with the substantially central portion of said second face, said threaded ring nut having a central threaded hole coaxial with the disk-shaped member that can be coupled with corresponding threaded means on the free end of the rotating shaft, wherein the threaded ring nut has a recess that houses a centering edge of a bearing flange of the rotating shaft.

2. Improved grinding wheel according to claim 1, wherein the threaded ring nut has spaced concentric annular recesses, in an outer said recess of which is disposed said disk-shaped member and in an inner said recess of which is disposed an annular portion of said bearing flange.

* * * * *